US006289869B1

(12) United States Patent
Elliott

(10) Patent No.: US 6,289,869 B1
(45) **Date of Patent: *Sep. 18, 2001**

(54) ELECTROMAGNETIC FUEL RAM-INJECTOR AND IMPROVED IGNITOR

(76) Inventor: George D. Elliott, 14902 Clovercrest Dr. SE., Huntsville, AL (US) 35803

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/152,142

(22) Filed: Sep. 11, 1998

Related U.S. Application Data

(60) Provisional application No. 60/058,700, filed on Sep. 12, 1997.

(51) Int. Cl.[7] ..... F02M 57/06

(52) U.S. Cl. ..... 123/297; 123/145 R

(58) Field of Search ..... 123/297, 143 R, 123/169 V, 298, 145 R, 145 A

(56) References Cited

U.S. PATENT DOCUMENTS

| | | | | |
|---|---|---|---|---|
| 4,469,059 | * | 9/1984 | Hukill | 123/169 PA |
| 4,603,667 | * | 8/1986 | Grunwald et al. | 123/297 |
| 4,787,349 | * | 11/1988 | Hilger | 123/297 |
| 4,834,043 | * | 5/1989 | Kaczynski et al. | 123/297 |
| 4,926,819 | * | 5/1990 | Auwarter et al. | 123/297 |
| 5,063,898 | | 11/1991 | Elliott | 123/297 |

* cited by examiner

*Primary Examiner*—Willis R. Wolfe
*Assistant Examiner*—Hieu T. Vo
(74) *Attorney, Agent, or Firm*—Alston & Bird LLP

(57) ABSTRACT

An electromagnetic fuel ram-injector and an improved fuel ignitor are disclosed for independent as well as cooperative use. The injector includes the use of two opposing radially slotted disc armatures attached to a single tubular ram rod to supply fuel to the injector. The ignitor includes the use of heated wire in conjunction with ceramic to provide an ignition source.

6 Claims, 2 Drawing Sheets

ELECTROMAGNETIC FUEL RAM-INJECTOR AND IMPROVED IGNITOR

CROSS-REFERENCE TO RELATED APPLICATIONS

This application claims the benefit of provisional patent application Ser. No. 60/058,700, filed Sep. 12, 1997.

TECHNICAL FIELD

The present invention generally relates to combustion systems, and particularly relates to an electromagnetic fuel ram-injector and improved ignitor.

BACKGROUND OF THE INVENTION

Electromagnetic fuel ram-injector and improved ignitors are known in the art. However, improvements are always needed.

SUMMARY OF THE INVENTION

The present invention overcomes deficiencies in the prior art by providing an improved electromagnetic fuel ram-injector and ignitor.

Generally described, the present invention relates to an electromagnetic fuel ram-injector and improved ignitor apparatus, comprising a fuel injector, and a fuel ignitor in series with the injector, to ignite fuel passing through the injector.

More particularly described, the present invention includes the use of in ignitor which includes an internal bore with in internal ignition wire.

More particularly described, the present invention includes the use of in ignitor which includes one or more internal bores with an external ignition wire.

Therefore it is an object of the present invention to provide an improved electromagnetic fuel ram-injector and improved ignitor.

It is a further object of the present invention to provide an improved electromagnetic fuel ram-injector.

It is a further object of the present invention to provide an improved ignitor.

It is a further object of the present invention to provide an improved electromagnetic fuel ram-injector and improved ignitor which can be used with a variety of fuels.

It is a further object of the present invention to provide an improved electromagnetic fuel ram-injector and improved ignitor which has long lasting performance features.

It is a further object of the present invention to provide an improved electromagnetic fuel ram-injector and improved ignitor which burns efficiently.

Other objects, features, and advantages of the present invention will become apparent upon reading the following detailed description of the preferred embodiment of the invention when taken in conjunction with the drawing and the appended claims.

DETAILED DESCRIPTION OF THE PREFERRED EMBODIMENT

The present invention generally relates to combustion engines, and particularly relates to a direct fuel injection system.

This direct injection invention delays the fuel injection, in an internal combustion engine, until time for ignition, and then ignites the fuel as it is being injected. With an unthrottled air intake this condition creates a modified cycle engine which, because of its hot-throated ignitor, permits the use of any of the presently used or considered for use fuels. The proximity of the unit's ignitor to the injector allows an extremely lean fuel/air operation, producing an efficient clean burning engine.

The use of this device creates a modified cycle internal combustion engine. No spark is needed, nor is a very high compression ratio needed such as in the case of diesel systems.

The air is not throttled such as in the case of a typical gasoline engine; the power output is regulated by the fuel injected.

The First Embodiment

Figure 1:
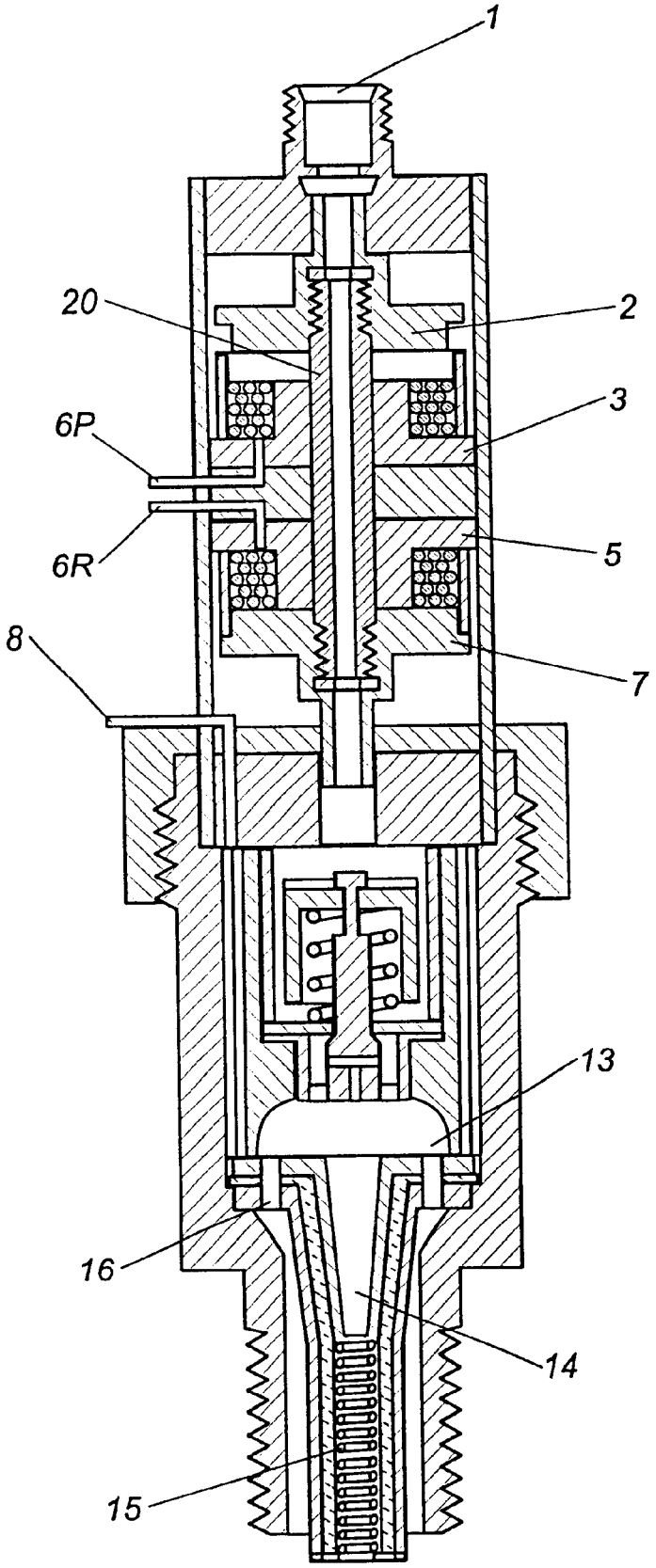
FIG. 1 shows a injector/ignitor unit.
Figure 2A:
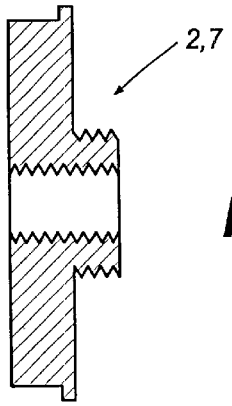
FIGS. 2A and 2B are side and end views, respectively, of an armature such as 2 and 7 shown in FIG. 1.
Figure 2B:
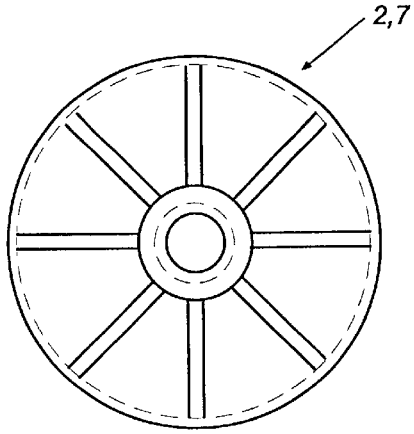
Figure 2C:
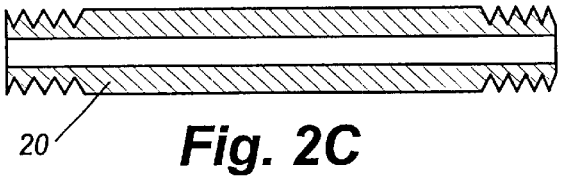
FIGS. 2C and 2D are side cross sectional and end views, respectively, of a tubular ram rod 20 such as shown in FIG. 1.
Figure 2D:
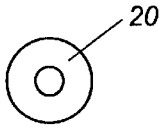
Figure 2E:
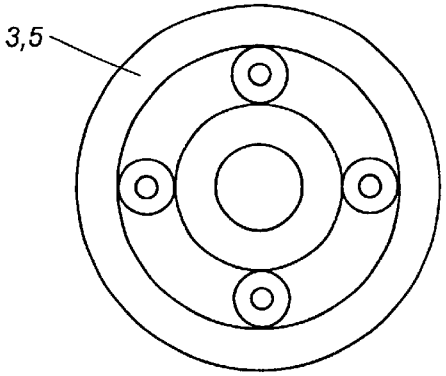
FIGS. 2E and 2F are end and side views, respectively, of a stator such as 3 and 5 shown in FIG. 1.
Figure 2F:
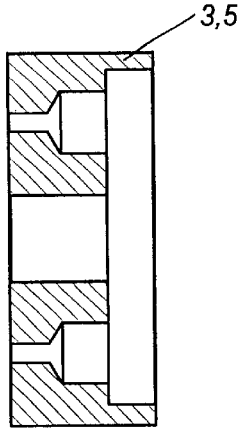
Figure 2G:
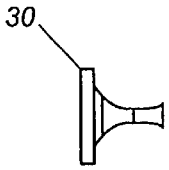
FIGS. 2G and 2H are side and end views, respectfully, of a ram poppet check valve 30 which could replace the reed valve shown in FIG. 1.
Figure 2H:
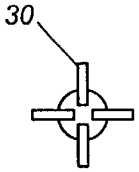
Figure 2I:
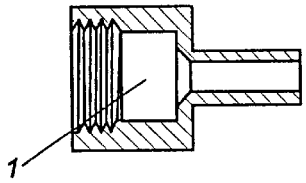
FIG. 2I is a side cross sectional view of a portion of a fluid ram unit such as shown in FIG. 1.

Reference is first made to FIGS. 1 and 2, which show various elements within a first embodiment according to the present invention. This mechanization (shown assembled in FIG. 1 and in certain parts in FIG. 2) utilizes two opposing radially slotted disc armatures attached to a single tubular ram rod to supply fuel to the units injector. These armatures are within the magnetic attraction field of their respective stators. The direction of movement of the ram is determined by which stator is electrically energized. The force exerted by the stator when applied through the ram, with the inherent mechanical advantage created by the ram's cross sectional area, generates a high fuel pressure. This high pressure is sufficient to operate any presently used fuel injectors, as well as the poppet valve in the invention unit.

Particularly, the first embodiment unit includes, among other elements, a Low Pressure Fuel Supply Inlet 1, a Ram Injection Armature Disc 2, an Injection Stator 3, a Return Stator 5, an Injection Coil Electrode 6P, a Return Coil Electrode 6R, a Ram Return Armature Disc 7, an Ignitor Electrode 8, one or more, a Valve Spring Retainer and Travel Limiter 10, a Valve Spring 11, a Poppet Valve 12, an Air/Fuel Mixing Chamber 13, a Hot Throated Venturi 14, an Ignitor Glow Element 15 (powered by electrode 8), and Air Passages 16.

Any unit internal fuel seepage or air pressure variations are relived through the unit center body outlet. High pressure outside fluid lines (fuel or hydraulic) are not needed to support the operation of this system.

Operation of the First Embodiment

In operation, the electronic control unit (see also U.S. Pat. No. 4,955,340) selects the injector to be used. Operating voltage is switched on to this inject stator, attracting its disc armature and pressurizing the units entrapped fuel. The duration of pressurization is controlled by the throttle setting, and determines the quantity of fuel injected. At the termination of injection the controller switches power to the return stator, pulling the ram back to initial position and recharging it's fuel supply, no springs are used. The ram is free floating, held in place only by the entrapped fuel. The ram pressurized fuel, forces the unit poppet valve open sending a dispersed stream of fuel through the unit air chamber mixing it with air and creating a localized rich fuel/air mixture. The fuel continues on through the glowing hot throat of the unit venturi (see also U.S. Pat. No. 5,063,898) which ignites it and into the cylinder chamber where its combustion is completed in the oxygen rich entrapped air of the engine cylinder.

The Second Embodiment

In the first embodiment, the igniter includes an heater wire for igniting the fuel, which is resistance wire inside an internal bore. In the second embodiment, a different ignitor configuration is used, having a ceramic rod (see FIG. 3) having four parallel lengthwise holes running through it. This entire ceramic rod is heated by heater wire outside the bore(s) to heat the fuel as it passes through the rod. It could be thought of as a fuel injector with an internal glow element.

The Second Embodiment Wire

The second embodiment still has resistance wire but it is wrapped on the outside of the ceramic rod, or at least embedded in the rod so that it is out of direct contact with the gas being burned.

For production purposes the wire could be added to the outside by conventional winding or applied by plasma deposition. The windings will also be covered by ceramic to further conceal them from flame.

The Second Embodiment Rod and the Holes

The ceramic rod has four parallel lengthwise holes running through its length As shown in FIG. 3 there are four holes through which the fuel can pass as it is being heated although other versions are possible.

Each of the four holes is approx 0.0625 (1/16") in diameter.

The diameter of the ceramic rod is 0.215 inches, and the length is the same as the first embodiment rod—about ¾ inches. Internal holes area of four holes should e.g. area of 4 holes is eg to ⅛".

The inventor at one time deliberately plugged the holes, but they were found to be self cleaning.

Operation of the Second Embodiment

When run current through the wire of the second embodiment, the ceramic rod is heated and glows.

The fuel is sprayed through the holes, which begins ignition which is completed in the combustion chamber.

Use in the First and Second Embodiment in a Motor

In an experiment provided by the inventor, a sleeve was threaded into the cylinder head to provide a mounting location as well as to provide additional compression volume and a lower compression ratio.

In one test, a sleeve was used having a bore diameter of about 11/16, and a length of about 1 and ½ inches. The use of the sleeve drops the 25:1 compression ratio in half to a 12.5:1 compression ratio, by doubling the compression volume.

When installed, one end of the sleeve was capped by BOSCH diesel fuel injector such as KCA30S35/4, and the other was installed into the head.

Control

Control of the second embodiment may be by the electronic controller shown the patent noted above, or by other means known in the art.

The Material

Conventional resistance wire can be used. In the second embodiment the wire can be embedded in the ceramic.

Miscellaneous

The types of fuels which may be used within the system include gasoline, diesel, alcohol, kerosene, or any mixtures thereof, or any known liquid fuel.

General Advantages/Operation

The inventive system allows a lean and clean burning system within a four stroke system.

With a diesel engine the fuel is injected early so that it can disperse and ignite due to the heat generated by the adiabatic system used by diesels. In contrast the present system injects just before the time of ignition and ignites the fuel as it is being injected, much as in the way a flame-thrower.

The use of this device creates a modified cycle internal combustion engine. No spark is needed, nor is a very high compression ratio needed such as in the case of diesel systems.

The air is not throttled such as in the case of a typical gasoline engine; the power output is regulated by the fuel injected.

Conclusion

While this invention has been described in specific detail with reference to the disclosed embodiments, it will be understood that many variations and modifications may be effected within the spirit and scope of the invention as described in the appended claims.

I claim:

1. An ignitor apparatus for igniting fuel supplied from a supply port, said ignitor apparatus comprising:

an ignitor apparatus portion defining an inlet port for accepting fuel from said supply port;

an ignitor apparatus portion defining a localized air chamber configured to mix said fuel with air to provide an air/fuel mixture;

an ignitor apparatus throat-defining portion defining a throat in communication with said localized air chamber for containing said air/fuel mixture; and an electrical heating device configured to heat said ignitor apparatus throat-defining portion.

2. The apparatus as claimed in claim 1, wherein said ignitor apparatus throat-defining portion is tubular and said heating device is electrical resistance wire.

3. An apparatus for igniting fuel supplied said from a supply port such that said fuel combusts within a combustion chamber, said apparatus comprising:

a) an ignitor apparatus portion defining an inlet port for accepting said fuel from said supply port;

b) an ignitor apparatus portion for directing said fuel through a localized air chamber spaced from said combustion chamber, said localized air chamber having air therein such that said fuel is mixed with air to provide an air/fuel mixture;

c) an ignitor apparatus portion for directing said air/fuel mixture through a throat having opposing first and second ends, said first end in communication with said localized air chamber and said second end in communication with said combustion chamber, such that said air/fuel mixture passes into said throat and at least partially into said combustion chamber; and d) an electrical heater for heating said ignitor apparatus throat-defining portion such that said air-fuel mixture is ignited within said throat and said combustion chamber.

4. The apparatus as claimed in claim 3, wherein said ignitor apparatus throat-defining portion is tubular and said heating device is electrical resistance wire.

5. A method of igniting fuel supplied said from a supply port such that said fuel combusts within a combustion chamber, said method comprising the steps of:

a) accepting said fuel from said supply port;

b) directing said fuel through a localized air chamber spaced from said combustion chamber, said localized air chamber having air therein such that said fuel is mixed with air to provide an air/fuel mixture;

c) directing said air/fuel mixture through a throat having opposing first and second ends, said first end in communication with said localized air chamber and said second end in communication with said combustion chamber, such that said air/fuel mixture passes into said throat and at least partially into said combustion chamber; and d) heating said ignitor apparatus throat-defining portion such that said air-fuel mixture is ignited within said throat and said combustion chamber.

6. The apparatus as claimed in claim 5, wherein said ignitor apparatus throat-defining portion is tubular and said heating device is electrical resistance wire.

* * * * *